US007059807B2

(12) United States Patent
Irvine

(10) Patent No.: US 7,059,807 B2
(45) Date of Patent: Jun. 13, 2006

(54) ELONGATED STRUCTURAL MEMBERS FOR USE IN FORMING BARRIER WALLS

(75) Inventor: John E. Irvine, Atlanta, GA (US)

(73) Assignee: CMI Limited Company, Atlanta, GA (US)

( * ) Notice: Subject to any disclaimer, the term of this patent is extended or adjusted under 35 U.S.C. 154(b) by 0 days.

(21) Appl. No.: 10/861,301

(22) Filed: Jun. 4, 2004

(65) Prior Publication Data

US 2005/0271479 A1 Dec. 8, 2005

(51) Int. Cl.
*E02D 5/74* (2006.01)
*E21D 20/00* (2006.01)

(52) U.S. Cl. ..... 405/262; 52/169.2; 405/279

(58) Field of Classification Search ..... 405/262, 405/274, 276–279, 284–286; 256/1; 52/155, 52/156, 169.1, 169.4, 223.6, 223.7, 223.14, 52/223.13

See application file for complete search history.

(56) References Cited

U.S. PATENT DOCUMENTS

| | | | | |
|---|---|---|---|---|
| 3,825,465 | A | 7/1974 | Stock | 428/135 |
| 4,355,448 | A | 10/1982 | Ezaki | 29/413 |
| 5,364,682 | A | 11/1994 | Tanaka et al. | 428/138 |
| 5,511,355 | A | 4/1996 | Dingler | 52/729.5 |
| 6,135,675 | A | 10/2000 | Moreau | 405/284 |
| 2002/0112428 | A1 | 8/2002 | Dingler | 52/309.16 |
| 2004/0013474 | A1* | 1/2004 | Weyant et al. | 405/276 |
| 2004/0013475 | A1 | 1/2004 | Weyant et al. | 405/284 |
| 2004/0013476 | A1* | 1/2004 | Weyant et al. | 405/284 |

OTHER PUBLICATIONS

NCEL Technical Note, N-1773, Timber Piling Barrier and Chemical Preservation Annual Costs Comparison, Jun. 1987, D. Pendleton and T. O'Neill, Naval Civil Engineering Laboratory Port Hueneme CA 93043.

NCEL Technical Note, N-1811, "Plastic Coatings and Wraps for New Marine Timber Piling," May 1990, David E. Pendleton, Naval Civil Engineering Laboratory Port Hueneme CA 93043-5003.

* cited by examiner

*Primary Examiner*—Thomas B. Will
*Assistant Examiner*—Tara L. Mayo
(74) *Attorney, Agent, or Firm*—Thomas, Kayden, Horstemeyer & Risley, LLP

(57) ABSTRACT

Briefly described, the present invention relates to a wale for use in forming a driven wall structure including a plurality of elongated structural panels. The wale includes a base wall, a top wall, a first side wall, and a second side wall. The base wall and the top wall are parallel, the first side wall and the second side wall extend between both the base wall and the top wall such that the wale is of a trapezoidal cross-section.

16 Claims, 4 Drawing Sheets

ELONGATED STRUCTURAL MEMBERS FOR USE IN FORMING BARRIER WALLS

TECHNICAL FIELD

The present disclosure relates generally to driven wall structures such as sea walls, piers, dikes, barrier walls and the like, constructed of extruded structural panels. More specifically, the present disclosure relates to structural members which are used to transfer load from the driven wall structure to an anchor system.

BACKGROUND OF THE INVENTION

Barrier walls that are formed from a plurality of elongated piles typically are driven into the earth to a depth sufficient to support the piles in an upright attitude. In some cases, the piles are in the form of extruded structural panels and are formed with male and female opposed edges so that similar panels can be locked together at their adjacent edges to form a continuous barrier wall. Because of the strength required of the structural panels when being driven into the earth and the strength required under load conditions, the panels have often been made of steel or aluminum. Although various methods exist to protect the steel and aluminum panels from the environment, such as using coatings or layers of paint, steel and aluminum panels have the tendency to suffer from corrosion, especially when used in aquatic environments. As well, steel and aluminum panels are relatively expensive to produce and heavy, which hinders installation operations.

In recent years, structural panels have been constructed of polyvinyl chloride and other plastics in order to reduce their weight and susceptibility to corrosion. However, these plastics have relatively low tensile and high compression strengths as compared to steel. To help maintain the structural panels in the desired positions, horizontally mounted structural elements, such as wales, are mounted along the outer surfaces of the structural panels and tie rods extend from the wale elements back through the panels to a force abutter disposed behind the barrier wall. Typically, the force abutter is a reinforced cement wall disposed a desired distance behind the barrier wall such that adequate retaining force is exerted from the force abutter through the tie rods against the barrier wall, thereby maintaining the barrier wall in the desired position. Instead of using a force abutter for several tie rods, individual ground anchors may be used with each tie rod. Typically, the wale elements that have been used to stabilize a retaining wall were comprised of wood. The use of wood in the wales risks significant damage from both exposure to the environment as well as from infestation of the wood elements by wood borers and other insects and organisms. Wale elements also have been comprised of steel and other metals which are susceptible to corrosion when used in aquatic environments such as those that exist near sea walls. Although the steel wale elements can be protected by coatings, these coatings must be breached when passing tie rods through the wale elements to the force abutter disposed behind the barrier wall. The points at which the protective coatings are breached leave the steel wale elements subject to corrosion. Preferably, the life cycles of the various components (wales, piles, anchor system, etc.) are each maximized in that replacement of one component often requires great effort and expense, even though the remaining components still perform adequately.

Existing wales tend to have square or rectangular cross-sections, meaning the bottom face of the wale is perpendicular to the wall. Therefore, when the wall is used as a sea wall, the bottom face of the wale can pose a threat to watercraft (boats, barges, etc.) in that portions of the watercraft can become caught underneath the wale due to wave action and/or tidal shifts. This not only can cause physical damage (scrapes, punctures, etc.), but restricting the free motion of the watercraft can pose stability problems. As well, force created wave action against the bottom face of the wale can affect the structural integrity of the sea wall over time.

Therefore, there is a need for improved structural members which address these and other shortcomings of the prior art.

SUMMARY

Briefly described, the present invention relates to a wale for use in forming a driven wall structure including a plurality of elongated structural panels. The wale includes a base wall, a top or outer wall, a first side wall, and a second side wall. The base wall and the outer wall are parallel, and the first side wall and the second side wall extend between both the base wall and the outer wall such that the wale is of a trapezoidal cross-section.

A further embodiment of a wale for use in forming a driven wall structure, the wall structure having a plurality of elongated structural panels and an anchor system, includes a base wall, an outer wall, a first side wall, and a second side wall. The base wall and the outer wall are parallel, and the first side wall and the second side wall extend between both the base wall and the outer wall. The wale also includes a first interior wall and a second interior wall. The first interior wall and the second interior wall extend between the base wall and the outer wall, thereby forming a first interior compartment of a first cross-section. The wale is disposed adjacent the wall structure.

The present disclosure also relates to a driven wall structure for retaining soil. The wall structure includes a plurality of elongated structural panels forming the wall structure, each of the structural panels having an inner surface, an outer surface, and being driven vertically into the soil adjacent a previously driven structural panel. At least one elongated wale is disposed adjacent the outer surface in a horizontal disposition. The wall structure further includes a wall cap having at least one inner cap member and one outer cap member. The inner cap member has an interior surface and an exterior surface, and the inner cap member extends along a top end of the wall structure such that the interior surface contacts portions of both the inner surface and the outer surface of the wall structure. The outer cap member has an interior surface and an exterior surface and extends along the top end of the wall structure such that at least a portion of the interior surface of the outer cap member is matingly received adjacent the exterior surface of the inner cap member. An anchor system for maintaining the wall structure in a fixed position includes an anchor member having a proximal end and a distal end, and a force abutter disposed on the inner side of the wall structure. The anchor member extends through the wale and the structural panel, and the distal end is secured adjacent the wale and the proximal end is secured adjacent the force abutter.

Yet another embodiment of the present disclosure relates to a driven wall structure for retaining soil. The wall structure includes a plurality of elongated structural panels, each of the structural panels having an inner surface, an outer surface, and being driven vertically into the soil adjacent a previously driven structural panel. The wall structure also includes at least one elongated wale, the wale having a base wall, an outer wall, a first side wall, and a second side wall, the base wall and the outer wall being parallel. The first side wall and the second side wall extend between both the base wall and the outer wall such that the wale is of a trapezoidal cross-section. A first interior wall and a second interior wall each extend between the base wall and the outer wall, thereby forming a first interior compartment of a first cross-section. A core structural member including a first pair of opposed walls and a second pair of opposed walls is slidably received within the first interior compartment. Each wall of the second pair of walls extends between the walls of the first pair of opposed walls, the base wall of the wale being adjacent to the outer surface. An anchor system for maintaining the wall structure in a fixed position includes an anchor member having a proximal end and a distal end, and a force abutter disposed on the inner side of the wall structure. The anchor member extends through the wale and the structural panel, and the distal end is secured adjacent the wale and the proximal end is secured adjacent the force abutter.

Other objects, features and advantages of the present invention will become apparent upon reading the following specification, taken in conjunction with the accompanying drawings.

BRIEF DESCRIPTION OF THE SEVERAL VIEWS OF THE DRAWINGS

Many aspects of the structural members can be better understood with reference to the following drawings. The components in the drawings are not necessarily to scale, emphasis instead being placed upon clearly illustrating the principles of the structural members. Moreover, in the drawings, like reference numerals designate corresponding parts throughout the several views.

DETAILED DESCRIPTION OF THE PREFERRED EMBODIMENT

Figure 1:
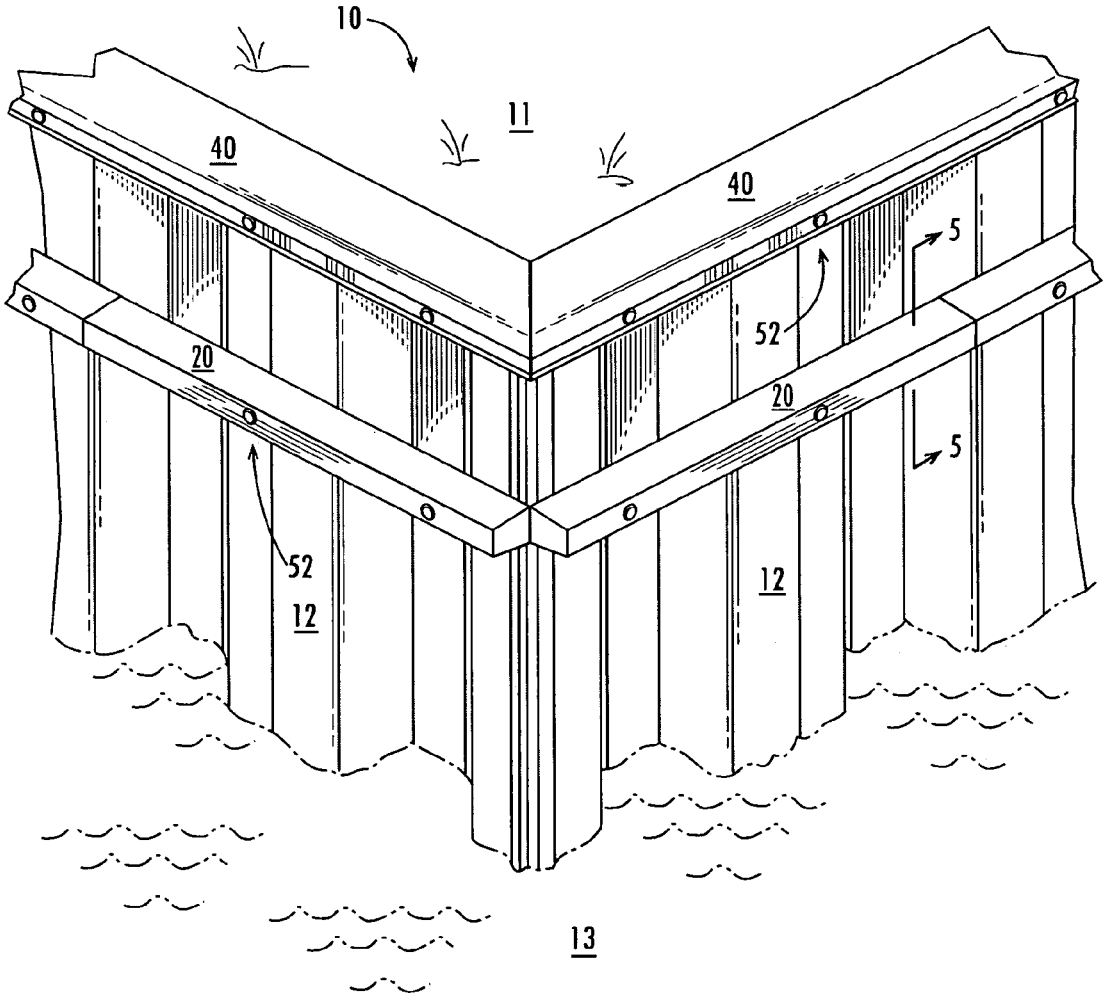
FIG. 1 is a perspective fragmentary view of a barrier wall constructed in accordance with an embodiment of the present disclosure, used as a sea wall.

Reference will now be made in detail to the description of the structural members as illustrated in the drawings. While the structural members will be described in connection with these drawings, there is no intent to limit it to the embodiment or embodiments disclosed therein. On the contrary, the intent is to cover all alternatives, modifications and equivalents included within the spirit and scope of the disclosure as defined by the appended claims.

Referring now in more detail to the figures in which like reference numerals identify corresponding parts, FIG. 1 illustrates a driven wall structure, in the form of a sea wall 10, constructed of elongated structural panels 12, wales 20, and a wall cap 40 according to the present disclosure. The sea wall 10 forms a retainer for the soil 11 on the backside of the sea wall 10, with water 13 at the front surface. The panels 12 extend vertically with lower ends received in the subsoil below the lower level of the body of water 13. Wales 20 are mounted along outer surfaces of the structural panels 12 and accept anchor members, such as tie bolts 52 (FIG. 5) or tie rods 52' (FIG. 6), which extend to force abutters 51 or similar anchors on the opposite side of the sea wall 10, as discussed in relation to FIGS. 5 and 6. A typical force abutter 51 can comprise an anchor wall of poured reinforced concrete placed behind the barrier wall 10 and extending generally parallel to the barrier wall. Several anchor members can be connected to a single force abutter 13. Also, a wall cap 40 is mounted along the upper ends of the structural panels 12 and can accept anchor members as well.

Figure 2:
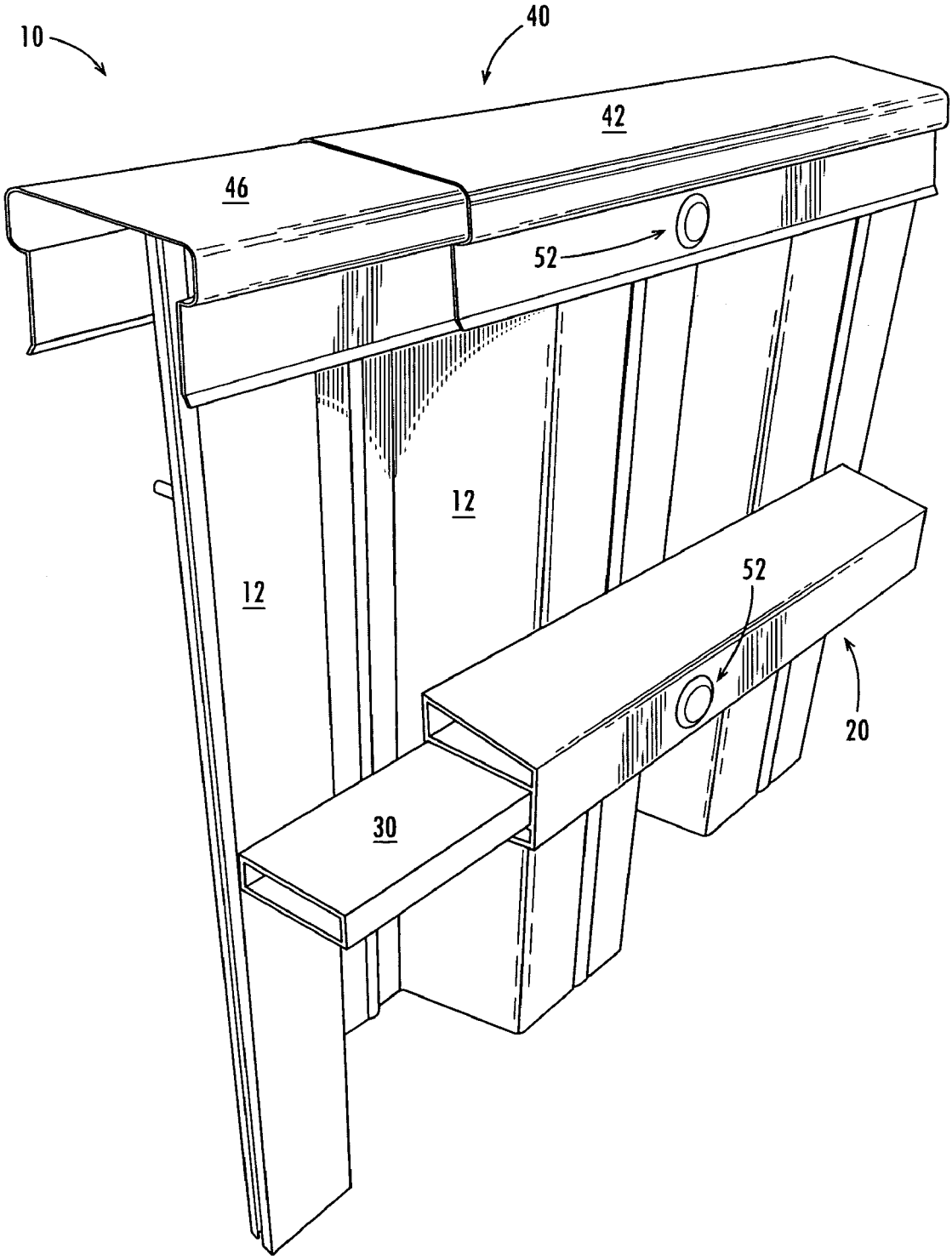
FIG. 2 is a perspective view of a portion of the barrier wall shown in FIG. 1 to illustrate the construction of the elongated structural members.
Figure 3:
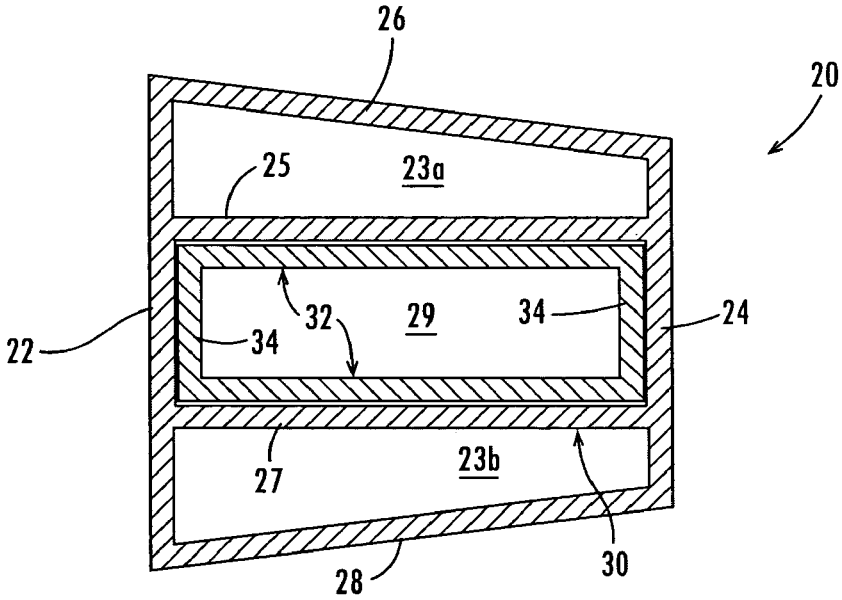
FIG. 3 illustrates a cross-sectional view of the wale as shown in FIG. 2.
Figure 4:
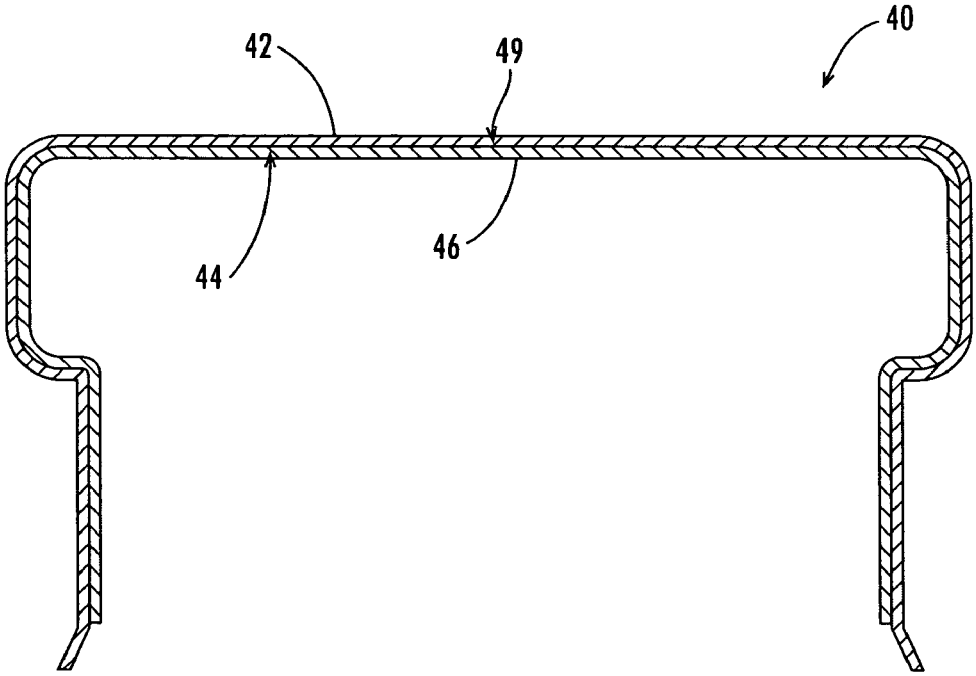
FIG. 4 illustrates a cross-sectional view of the wall cap as shown in FIG. 2.

Referring now to FIGS. 2–4, and as best seen in FIG. 3, each wale 20 forms a constant, uniform cross-section from end-to-end. Preferably, each wale 20 has a trapezoidal cross-section formed by a base wall 22, an outer wall 24, and first and second side walls 26 and 28 which intersect the base wall 22 and outer wall 24 at similar angles, respectively. Further, each wale 20 preferably includes a first interior wall 25 and a second interior wall 27, each of which extends from the base wall 22 to the outer wall 24, thereby forming the first interior compartment 29 with portions of the base wall 22 and outer wall 24. Preferably, the first interior wall 25 and second interior wall 27 are parallel and both intersect the base wall 22 and outer wall 24 at right angles as shown. The first interior compartment 29 is configured to slidably receive a core structural member 30 having a similar cross-section to the first interior compartment 29. As shown, the core structural member is formed of pairs of opposed walls 32 and 34.

Core structural members 30 can be used for splicing adjacent wales 20 together (preferably in 1 to 2 foot lengths), or can provide additional structural integrity to the wales 20 (the core structural members 30 running the entire length of the wales 20). Note, embodiments of wales 20 are envisioned wherein the first interior wall 25 and second interior wall 27 are omitted. Core structural members 30 for these embodiments would preferably have trapezoidal cross-sections so that they could be slidably received within the trapezoidally shaped wale 20. Preferably, the wales 20 and core structural members 30 are constructed of extruded aluminum or pultruded fiberglass reinforced plastic (FRP).

As shown in FIGS. 2 and 4, the wall cap 40 includes an outer cap member 42 and an inner cap member 46, each having a constant, uniform cross-section from end-to-end. Preferably, the inner cap member 46 is dimensioned such that its interior surface 48 is adjacent to portions of the inner surface and outer surface of the driven structural panels 12 when placed along the top of the wall 10. As well, the inner cap member 46 and outer cap member 42 are dimensioned such that the inner cap member 46 is slidably received within the outer cap member 42, the interior surface 44 of the outer cap member 42 and the exterior surface 49 of the inner cap member 46 being adjacent. Preferably, the outer and inner cap members 42 and 46 have uniform thicknesses from 0.250 to 0.600 inches, more preferably from 0.250 to 0.500 inches, and are constructed of aluminum or fiberglass reinforced plastic. Ideally, when being used as an aesthetic wall cap 40, outer cap members 42 are run for the length of the sea wall 10, with portions of the inner cap member 46 (preferably 1 to 2 foot sections) used as splices to connect the adjacent outer cap members 42. As well, for increased structural integrity, the wall cap 40 may include inner cap members 46 running the entire length of the sea wall 10 for which the outer cap members 42 are run.

Figure 5:
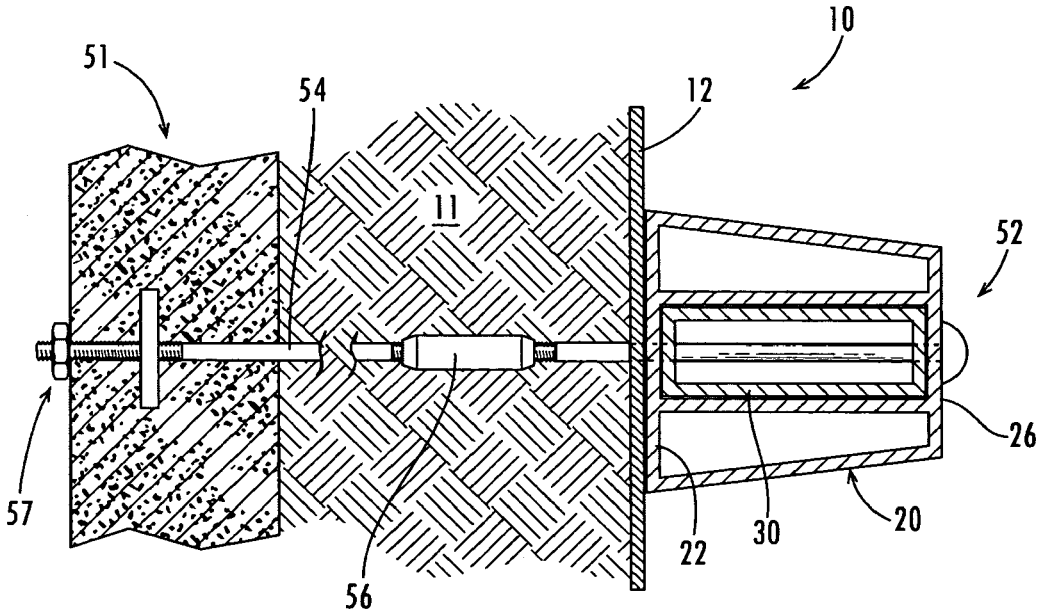
FIG. 5 illustrates a partially cut-away, side elevation of the barrier wall, abutter and anchor rod as shown in FIG. 1, taken along line 5—5.

FIG. 5 is a cross-sectional view of an anchor system taken along line 5—5 of FIG. 1. Typically, when a structural panel 12 is to be driven into the earth, the structural panel 12 is positioned above and adjacent a previously installed structural panel 12. The structural panel being installed is then moved downwardly so that locking elements (not shown), typically male and female elements, guide along the length of the locking elements of the adjacent previously installed panel. The structural panel 12 is progressively moved downwardly by driving, vibration, gravity or other external forces, until the upper end of the structural panel 12 becomes located at approximately the desired height. If necessary, the upper ends of the structural panels 12 that do not reach the desired height can be cut away.

After adjacent structural panels 12 have been driven to the desired height, an anchor system is installed. Portions of the anchor system shown in FIG. 5 include a first anchor member 52 (preferably a tie bolt), a second anchor member 54 (a tie rod), a turn buckle 56, and a threaded fastener 57. To secure the wall 10 in a desired position, a plurality of wales 20 are positioned horizontally along the outer surface of the wall 10 for support. As shown, the base wall 22 of each wale 20 is adjacent the structural panels 12. As previously noted, the wale 20 is trapezoidal in cross-section. This permits the present wales 20 to have the same amount of surface area of each base wall 22 in contact with the structural panels 12 as would a typical square wale, yet each present wale 20 is of a smaller cross-sectional area. As well, when the cross-sectional areas of the present wale 20 and a typical square wale are the same, the present wale 20 has a greater surface area in contact with the structural panels 12. Therefore, point loading on the structural panels 12 is reduced because the forces are exerted over a larger area. Note also, the bottom side wall 28 extends upwardly away from the outer surface 16 of the structural panel 12 such that objects (debris, watercraft, etc.) are deflected outwardly from the wall rather than being trapped. The side wall 28 similarly deflects waves, thereby reducing the forces exerted on the wall.

Next, a core structural member 30 is slidably disposed within the first interior compartment 29 of the wale 20. As previously stated, core structural members 30 may be used to splice adjacent wales 20 together, or may be used to increase the structural integrity of the wales 20 by running the core structural members 30 the entire length of the sea wall 10. After positioning the core structural member 30, the installer can drill holes through the wale 20, core structural member 30, and structural panel 12 that are required to receive a portion of the anchor system, such as an anchor member. Preferably, these holes are drilled where the base wall 22 of the wale 20 is in direct contact with a structural panel 12, thereby exerting maximum retention force on the wall 10. However, these holes may also be drilled where the wales 20 are not in direct contact with the wall 10.

The plurality of second support members 54, preferably tie rods, are installed such that one end is securely attached to a force abutter 51, in this case a poured reinforced concrete wall that runs substantially adjacent to the wall 10 at a desired distance in the soil 11 behind the wall 10. The opposite end of each tie rod 54 is threadably secured to one end of a turn buckle 56, which has threaded receptacles at opposed ends. Next, the plurality of first anchor members 52, each including a threaded end and an end with a dome-shaped head, are installed. Typically, each threaded end of the first anchor member 52 is passed through the outer wall 24 of the wale 20, the core structural member 30, the base wall 22 of the wale 20, and the structural panel 12 of the wall 10. The domed head of each anchor member acts as a force spreader such that the force exerted on the wale 20 is evenly distributed. The threaded end of each anchor member is then secured to the threaded receptacle of the turn buckle 56 opposite the one to which the second anchor member 54 is secured. The turn buckle 50 is then rotated to exert either greater or less force on the wall 10. This process is repeated until an adequate number of anchor members are installed along the wall 10 such that adequate force is exerted thereon to hold the wall 10 in the desired position. Similarly, anchor members can also be passed through the outer and inner cap members 42 and 46 to exert force on the sea wall 10 by way of the wall cap 40.

Figure 6:
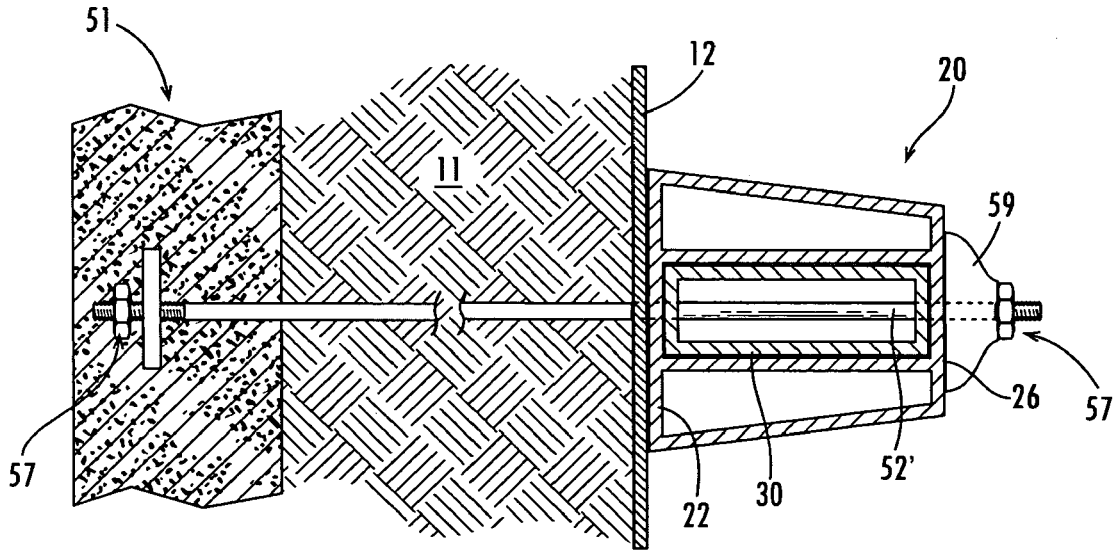
FIG. 6 illustrates a partially cut-away, side elevation of the barrier wall and abutter shown in FIG. 1, with an alternate embodiment of an anchor rod as that shown in FIG. 5.

FIG. 6 is a cross-sectional view of an alternate embodiment of an anchor system for use with a wale 20 according to the present disclosure. After adjacent structural panels 12 have been driven to the desired height, an anchor system is installed. The anchor system as shown in FIG. 6 differs primarily from that as shown in FIG. 5 in that tie rods 52' and ogee washers 59 are used to transfer retention forces from the force abutters 51 to the sea wall 10. To secure the wall in a desired position, the plurality of wales 20 and core structural members 30 are positioned along the sea wall 10 as previously discussed. After so positioning the wales 20 and core structural members 30, the installer can drill holes therethrough at the desired points, as previously noted.

Next, the plurality of tie rods 52' are installed such that one end is securely attached to the force abutter 51. The opposite end of each tie rod 52' is passed through the structural panel 12, the wale 20, and the core structural member 30 such that it is exposed on the exterior surface of the wall 10. Preferably, a force spreader such as an ogee washer 59 is placed about the tie rod 52' such that the force exerted on the wale 20 is evenly distributed. Lastly, the ogee washer 59 is secured adjacent the wale 20 with a threaded fastener 57. This process is repeated until an adequate number of tie rods 52' are installed along the wall 10 such that adequate force is exerted thereon to hold it in the desired position.

Although preferred embodiments of the structural members have been disclosed in detail herein, it will be obvious to those skilled in the art that variations and modifications of the disclosed structural members can be made without departing from the spirit and scope of the structural members as set forth in the following claims.

The invention claimed is:

1. A driven wall structure for retaining soil, comprising:

a plurality of elongated structural panels, each said structural panel having an inner surface, an outer surface, and being driven vertically into the soil adjacent a previously driven structural panel;

at least one elongated wale, said wale including:

a base wall, an outer wall, a first side wall, and a second side wall, said base wall and said outer wall being parallel, each said first side wall and said second side wall extending between both said base wall and said outer wall such that said wale is of a trapezoidal cross-section;

a first interior wall and a second interior wall, each said first interior wall and said second interior wall extending between said base wall and said outer wall, thereby forming a first interior compartment of a first cross-section;

a core structural member including a first pair of opposed walls and a second pair of opposed walls, each wall of said second pair of opposed walls extending between said walls of said first pair of opposed walls, at least a first portion of said core structural member being slidably received within said first interior compartment;

said base wall of said wale being adjacent said outer surfaces of said plurality of structural panels;

an anchor system for maintaining said wall structure in a fixed position, said anchor system including an anchor member having a proximal end and a distal end, and a force abutter disposed at said inner surfaces of panels; and wherein said anchor member extends through said wale and said structural panel, said distal end being secured to said wale and said proximal end being secured to said force abutter.

2. The driven wall structure of claim 1, wherein said first cross-section of said first interior compartment and said core structural member are rectangular.

3. The driven wall structure of claim 1, wherein said anchor member further extends through said first portion of said core structural member.

4. The driven wall structure of claim 1, wherein said base wall is wider than said outer wall.

5. The driven wall structure of claim 1, wherein said force abutter further comprises an anchor wall disposed in the soil and said anchor member further comprises a tie-rod.

6. The driven wall structure of claim 1, further comprising a wall cap including:

at least one inner cap member having an interior surface and an exterior surface, said inner cap member extending along a top end of said wall structure such that said interior surface contacts portions of both said inner surface and said outer surface of said wall structure;

at least one outer cap member having an interior surface and an exterior surface, said outer cap member extending along said top end of said wall structure such that at least a portion of said interior surface of said outer cap member is matingly received adjacent said exterior surface of said inner cap member.

7. A wale for use in forming a driven wall structure, the wall structure including a plurality of elongated structural panels and an anchor system, the wale comprising:

a base wall, an outer wall, a first side wall, and a second side wall, said base wall and said outer wall being parallel, each said first side wall and said second side wall extending between both said base wall and said outer wall;

a first interior wall and a second interior wall, each said first interior wall and said second interior wall extending between said base wall and said outer wall, thereby forming a first interior compartment of a first cross-section; and wherein said wale is disposed adjacent said wall structure, said wale further includes:

a core structural member including a first pair of opposed walls and a second pair of opposed walls, each wall of said second pair of opposed walls extending between said walls of said first pair of opposed walls; and wherein said first interior compartment is rectangular in cross-section as is said core structural member.

8. A wale for use in forming a driven wall structure as set forth in claim 7, wherein said core structural member is slidably received in said first interior compartment.

9. A wale for use in forming a driven wall structure as set forth in claim 8, wherein the anchor system further includes an anchor member having a proximal end, a distal end, and a force abutter disposed adjacent an inner side of said wail structure; and wherein said anchor member extends through said wale and said wall structure, with said distal end being secured to said wale and said proximal end being secured to said force abutter.

10. A wale for use in forming a driven wall structure of claim 9, wherein said anchor member further extends through said core structural member.

11. A wale for use in forming a driven wall structure of claim 7, wherein the anchor system further includes an anchor member having a proximal end, a distal end, and a force abutter disposed on an inner side of said wall structure; and wherein said anchor member extends through said wale and said wall structure, said distal end being secured adjacent said wale and said proximal end being secured adjacent said force abutter.

12. A wale for use in forming a driven wall structure, the wall structure including a plurality of elongated structural panels, said wale comprising:

a base wall for bearing against the structural panels, an outer wall opposed to said base wall, a first side wall, and a second side wall, said base wall and said outer wall being parallel, and said first side wall and said second side wall diverging from each other as they extend from said outer wall to said base wall such that said wale is of a trapezoidal-cross-section with said base wall being wider than said outer wall; and an anchor system for mounting said wale to the structural panels including a distal end for connection to said wale and extending through said wale and one of the structural panels and a proximal end for connection to a force abutter, wherein said base wall is disposed adjacent said wall structure and force is applied to the outer wall and transmitted from said outer wall through the diverging first and second side walls to said base wall, and from said base wall to the structural panels.

13. The wale of claim 12, wherein said wale is constructed of aluminum.

14. The wale of claim 12 wherein said outer wall and said base wall are flat, and further including at least one interior wall extending from said outer wall to said base wall for transmitting force from said outer wall to said base wall.

15. The wale of claim 14, and further including a core structural member slidably received in said wale.

16. A driven wall structure for retaining soil, comprising:

a plurality of elongated structural panels, each said structural panel having an inner surface, an outer surface, side edges connected to the side edges of adjacent panels, and being driven into the soil and forming a wall;

a plurality of elongated wales aligned with one another, each having a length extending laterally along the outer surfaces of said structural panels, said wales each including:

a base wall for bearing against the outer surfaces of the structural panels, an outer wall of less breadth than said base wall opposed to and parallel to said base wall, opposed side walls extending between said outer wall and said base wall and diverging outwardly from each other from said outer wall toward said base wall such that said wale is of a quadrilateral cross-section;

said base wall of said wales being applied to said outer surfaces of said structural panels;

a plurality of anchors for connecting the wales to a force abutter positioned adjacent the inner surfaces of the structural panels and maintaining said wall in a fixed position, said anchors each including a tie rod having a proximal end and a distal end and a fastener attached to said distal end;

said tie rods having their distal ends extending through said outer wall of said wales and through said base wall of said wales and extending through said structural panels, said fasteners attached to the distal ends of said tie rods, said fasteners bearing in flat abutment against the outer wall of the wales and said proximal end of said tie rods extending away from said structural panels for being secured to the force abutter;

such that the force abutter applies tension to the tie rods and the fasteners apply the force from the tie rods against the outer wall of the wale and the force applied to the outer wall is spread by the side walls of the wale to the larger base wall of the wale and by the base wall against the structural panels; and a core structural member having opposed ends slidably received in adjacent ones of the aligned wales and connecting the wales in alignment with one another.

* * * * *